US008297099B2

(12) United States Patent
Seidel

(10) Patent No.: US 8,297,099 B2
(45) Date of Patent: Oct. 30, 2012

(54) METHOD AND APPARATUS FOR ROLLER LUBRICATION

(75) Inventor: Juergen Seidel, Kreuztal (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 383 days.

(21) Appl. No.: 12/375,564

(22) PCT Filed: Apr. 4, 2008

(86) PCT No.: PCT/EP2008/002691

§ 371 (c)(1),
(2), (4) Date: Mar. 4, 2009

(87) PCT Pub. No.: WO2008/148438

PCT Pub. Date: Dec. 11, 2008

(65) Prior Publication Data

US 2011/0094829 A1 Apr. 28, 2011

(30) Foreign Application Priority Data

Jun. 8, 2007 (DE) ..... 10 2007 026 579
Sep. 8, 2007 (DE) ..... 10 2007 042 898

(51) Int. Cl.
*B21B 27/06* (2006.01)
*B21B 28/00* (2006.01)

(52) U.S. Cl. ..... 72/236

(58) Field of Classification Search ..... 72/236
See application file for complete search history.

(56) References Cited

U.S. PATENT DOCUMENTS

| | | | | |
|---|---|---|---|---|
| 4,592,002 | A | 5/1986 | Bozarth, Jr. et al. | |
| 4,768,280 | A * | 9/1988 | Palmer et al. | 29/527.4 |
| 5,090,225 | A | 2/1992 | Schimion | 72/45 |
| 5,524,465 | A | 6/1996 | Kajiwara | 72/42 |
| 6,089,069 | A | 7/2000 | Seidel | 72/236 |
| 6,210,501 | B1 * | 4/2001 | Okano et al. | 72/39 |
| 6,497,127 | B2 * | 12/2002 | Nishiura et al. | 72/236 |
| 7,159,433 | B2 | 1/2007 | Seidel | 72/201 |
| 7,266,984 | B2 | 9/2007 | Cerv | 72/236 |
| 2003/0150060 | A1 | 8/2003 | Huang | |

FOREIGN PATENT DOCUMENTS

| | | |
|---|---|---|
| CA | 2547960 | 7/2005 |
| CA | 2618836 | 3/2007 |
| JP | 052114550 A | 9/1977 |
| JP | 56139213 | 10/1981 |
| JP | 05146816 A | 6/1993 |
| JP | 07016621 | 1/1995 |
| JP | 07016621 A | 1/1995 |
| JP | 08215717 A | 8/1996 |

* cited by examiner

*Primary Examiner* — Teresa M Ekiert
(74) *Attorney, Agent, or Firm* — Andrew Wilford

(57) ABSTRACT

The roll gap in a rolling stand for rolled strips is lubricated by feeding water via at least a first feed line and oil via at least a second feed line to at least one mixer, mixing the water and the oil in the mixer, feeding the mixture of water and oil to a sprayer, and spraying the mixture from the sprayer onto at least one work roll or backup roll of the rolling stand. To clean the roll gap hot water or steam is fed via at least one third feed line to one of the first and second feed lines or to the mixer at defined time intervals or as a function of a status of the rolling process while a roll of the rolling stand is being changed.

13 Claims, 1 Drawing Sheet

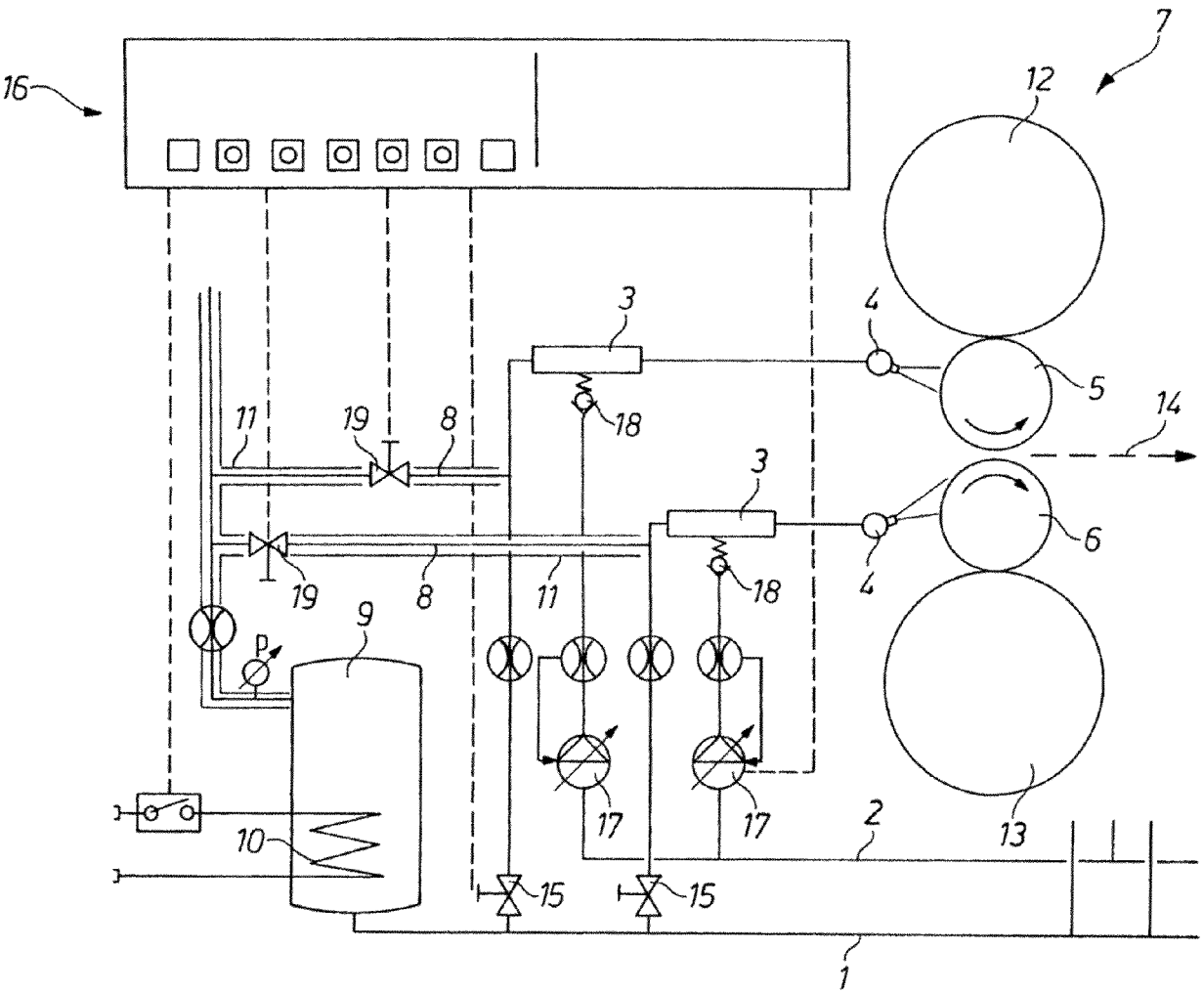
7
12
5
14
6
13
4
4
2
1
3
18
17
15
3
18
17
11
15
8
8
19
9
19
P
11
10
16

METHOD AND APPARATUS FOR ROLLER LUBRICATION

CROSS REFERENCE TO RELATED APPLICATIONS

This application is the US-national stage of PCT application PCT/EP2008/002691, filed 4 Apr. 2008, published 11 Dec. 2008 as WO2008/148438, and claiming the priority of German patent application 102007026579.6 itself filed 8 Jun. 2007 and German patent application 102007042898.9 filed 8 Sep. 2007, whose entire disclosures are herewith incorporated by reference.

FIELD OF THE INVENTION

The invention relates to a method for roller lubrication, in particular for lubricating the roller gap in a rolling stand for rolled strips, in which water is supplied via at least a first feed line and oil is supplied via at least a second feed line to at least one mixer, wherein the water and the oil are mixed in the is mixer and wherein the mixture of water and oil is supplied to a sprayer with which the mixture is sprayed onto at least one roller of a rolling stand. Furthermore, the invention relates to an apparatus for roller lubrication, in particular for carrying out the method.

BACKGROUND OF THE INVENTION

Roller gap lubrication systems are often installed in roiling trains. These are used for the purpose of improving the surface quality of the work roll and the strip and are included in the normal equipment of a modern rolling train on which high-quality strips are to be fabricated.

The system in which water as the carrier medium and oil are mixed just upstream of the roller and applied to the work roll or backup roll and ultimately take effect in the roller gap is the most widespread owing to its simplicity. DE 10 2004 006 130 [CA 2,547,960], EP 1 399 276 [U.S. Pat. No. 7,266,984], EP 1 399 277 [U.S. Pat. No. 7,159,433], EP 0 367 967 [U.S. Pat. No. 5,090,225] and WO 2007/025682 [CA 2,618,836] disclose solutions of this type.

After a certain operating time, however, the effectiveness of the lubrication is reduced or the results of the roller gap lubrication cannot be reproduced. The lubrication effect is also often uneven over the width of the strip, which leads to problems in the movement of the strip. The cause of this is often that the piping between the oil/water mixer and the spray nozzles becomes clogged in layers as a result of saponification. Blockages of the small nozzles also occurs when particles become detached from the wails and float in front of the nozzle outlet.

A relatively large outlay on maintenance is necessary as a result of mechanical cleaning of the system or periodical rinsing of the piping between the oil/water mixer and the nozzles and blowing the nozzles clear.

JP 7016621 discloses periodically stopping the oil supply and carrying out a rinse of the nozzles with the water which is also used for forming the oil/water mixture.

JP 56139213 provides for a cleaning solution to be able to be introduced into the fluid lines as required in order to clean them.

In order to reduce the saponification of the roller gap lubrication system, particular demands are additionally made of the water quality or water analysis, which however makes water consumption considerably more expensive. In order to adapt the oil to the water quality, additives are added to the oil.

These vary in their composition and effect in the different water qualities worldwide. Determining the oil composition is expensive, which along with the additives themselves ultimately has a detrimental effect on oil costs. Despite the expense, the oil is not always adapted optimally to the water used.

OBJECT OF THE INVENTION

The object of the invention is therefore to provide a method and an associated apparatus with which it is possible to ensure in a simple and efficient manner continuous roller gap lubrication which has a constant quality over time. This is to be made possible in a manner which is simple and as environmentally friendly as possible. In addition, the process should not be detrimentally effected by it.

SUMMARY OF THE INVENTION

The solution of this object by the invention is characterized according to the method in that hot water, steam or a chemical detergent, or a combination of two media, is supplied via at least a third feed line to the first or the second feed line and/or to the mixer at defined time intervals or as a function of a status of the rolling process.

Hot water or steam or other cleaning media are preferably supplied during the change of a roller of the rolling stand or at the end of a rolling program before a relatively long, different type of system stoppage.

Furthermore, the cleaning procedure takes place with for example hot water following a rolling incident within the rolling train in order to remove any oil residues on the rolls.

The supplied hot water preferably has a temperature of at least 60° C. The hot water or steam is advantageously supplied over a period of 2 to 15 minutes.

A detergent, in particular a chemical detergent, can additionally or periodically be added to the hot water or steam, which detergent is capable of dissolving stubborn oil residues.

In the event of interrupted supply, hot water or steam is preferably delivered in the first or in the second feed line.

A warning signal can be output during the delivery of hot water or steam in order to prevent the risk of staff being scalded.

The water can be heated or the steam can be generated by means of an electric heating element, by means of oil or gas heating or by means of solar energy (where applicable only auxiliary). Heating takes place during rolling and is available for cleaning on request.

The apparatus according to the invention for roller lubrication is characterized in that at least one third feed line is present, which is connected fluidically at one end to at least one of the first or second feed lines and/or to the mixer and which is connected at its other end to a supply for hot water or steam.

The supply for hot water or steam can have at least one electric heating element, oil or gas heating or solar heating. For energy saving reasons, the supply (container) is advantageously thermally insulated.

The at least third feed line is preferably also at least partially provided with thermal insulation.

Finally, a development provides for the supply for hot water or steam to be able to be coupled fluidically to the first feed line for water.

In systems which have a variable flow admittance and have valves installed for this purpose, the valves are cleaned as well. To this end, all valves are opened and the cleaning is carried out over the entire gauge.

With this cleaning technology, the roller gap lubrication system can also be operated with water and/or oil of relatively low quality, which is more cost-effective and therefore more economical altogether. Furthermore, the conditions for lubricating the roller gap can always be reproduced.

An exemplary embodiment of the invention is shown in the drawing. The single FIGURE schematically shows an apparatus for roller gap lubrication in a rolling stand for rolled strips, which apparatus is equipped with an integrated cleaning device.

BRIEF DESCRIPTION OF THE DRAWING

The sole FIGURE of the drawing is a schematic diagram of an apparatus for carrying out the method of this invention.

DETAILED DESCRIPTION

The drawing shows an apparatus with which a roller gap is lubricated with a water/oil mixture. A rolling stand 7 is shown schematically, in which two work rolls 5 and 6 interact and form a roller gap, with the work rolls 5, 6 being supported by backup rolls 12 and 13. A strip 14, which is rolled in the rolling stand 7, is also schematically shown.

Two feed lines 1 and 2 are provided in order to feed the rolls and the roller gap with lubricating fluid. The feed line 1 delivers water from an unillustrated source while oil is supplied via the feed line 2. Both the water and the oil are supplied to mixers 3 in which the two fluids are mixed. The mixture is then conducted to sprayers 4 in the form of spraying bars and sprayed via the latter onto the rolls 5, 6.

Water shutoff valves 15 connected to the feed line 1 can be actuated by a central controller 16 (indicated by the dashed lines). Similarly, oil flow from the second feed line 2 can also be influenced by the controller 16. To this end, oil pumps 17 are connected to the second feed line 2 and deliver oil to the mixers 3, to build up their pressure through check valves 18. Alternatively, switchable open/close valves that open when the oil pumps 17 are actuated can be used instead of the check valves 18.

It is essential that a cleaning medium such as hot water or steam is supplied via at least one third feed line 8 to the first or the second feed line 1, 2 and/or to the mixer 3 at defined time intervals or as a function of a status of the rolling process.

For this purpose, a supply 9 feeds hot water or steam into the third feed lines 8. Shutoff valves 19 are also arranged in the third feed lines 8 and can be actuated by the central controller 16. So that the loss of temperature between the supply 9 and the mixers 3 is as low as possible, thermal insulation 11 is placed around the lines 8.

The hot water or the steam can in principle be generated in the supply 9 in any desired manner. In the illustrated embodiment an electric heating element 10 is provided. The water in the supply can thereby be heated to temperatures between 60 and 95° C.

In order to prevent the mixers 3 and/or the sprayers 4 from becoming clogged, automatic maintenance and cleaning of the roller gap lubrication system is provided. The system is easy to manage and integrated in the overall automation system of the rolling mill. To this end, the region between the mixer (oil/water mixer) 3 and the respective sprayer (nozzle) 4 is regularly cleaned with hot water or with superheated steam, where necessary with addition of chemical detergents, for which a time of approx. 5 minutes is typically to be estimated.

It has been shown that saponification in the lines can be dissolved again if hot water with a water temperature of at least 60° C. is used.

The cleaning process is carried out automatically after every use of the roller or a predetermined number of uses of the roller (rolling programs), or after every use of the roller gap lubrication or a predetermined number of uses, so that a saponification layer which becomes thicker and thicker cannot form, but rather the thin layer is removed again every time after use.

The following procedure is preferably provided:

When the roller gap lubrication is used during the rolling process, the cold water flows constantly through the first feed line 1 and through the mixers 3 and exits through the sprayers 4. The oil pumps 17 open the check valves 18 by means of the pressure and the oil enters the mixers 3, mixes with the water and exits the spraying bar 4 as a dispersion. The dispersion is applied in the exemplary embodiment to the upper and lower work rolls 5, 6 or alternatively to the backup rolls (spraying bar not shown), by means of which the oil reaches the roll gap.

At the end of any rolling program, directly after the last strip exits the rolling train, the cleaning procedure of the roll gap lubrication is automatically started. This is possible without disrupting operation while a roll is being changed or temporarily changed. The stands to be cleaned are selected by means of a process model as a function in particular of the quantity of oil used, of the activation of the roll gap lubrication and of the duration of cleaning during the last stoppage. The duration of cleaning can be set between 2 and 15 minutes.

The oil pumps 17 are switched off or are already switched off here. The supply of cold water via the first feed line 1 is switched off (water shutoff valve 15 closed). The supply of warm water is activated for the previously specified time for cleaning. Cleaning is switched off after the time has elapsed or can be switched off manually by the user.

The cleaning process for one or a plurality of stands 7 is started by means of a process model or automation or else manually by a user. To this end, the shutoff valves 19 open and the hot water can flow out of the heat-insulated warm water container 9 via the shutoff valves 19 through the oil/water mixer 3 and exits likewise at the spraying bar 4. So that the loss of heat from the water is not too great during transport from the warm water container 9 to the nozzle bar 4, the feed line 8 from the warm water container 9 to the nozzles 4 is surrounded with the said heat insulation 11.

During cleaning with the hot water or alternatively with the steam, a warning lamp on the rolling stand 7 is automatically activated, in order to preclude staff being scalded.

Once the predetermined time has elapsed or the roll change has finished, the cleaning of the roll gap lubrication system is deactivated again and the roll gap lubrication is switched back to operational.

As mentioned, the heating in the warm water container 9 is electrical. Alternatively, oil or gas heating with or without solar-support is also possible. The use of waste heat is likewise possible.

Regular, automatic cleaning of the roll gap lubrication by means of a cleaning medium can therefore take place. Cleaning preferably takes place at the start of any break in rolling or after a defined number of breaks in rolling.

The cleaning cycle is preferably controlled and monitored by a process model as a function of the oil quantity, of the activation of the roll gap lubrication etc.

The cleaning medium is supplied in the roll gap lubrication system upstream of the oil/water mixer 3 itself, so that the region between the mixer 3 and the exit nozzle 4 can be rinsed.

Any stand can be cleaned individually or together in groups.

Hot water with a temperature of more than 60° C. or steam is advantageously provided as the cleaning medium, with it being possible to add a chemical oil-dissolving agent.

The use of normal (filtered) water quality is possible for the roll gap lubrication.

The respective cleaning duration for each stand 7 can be stored or logged and used for making decisions about the next cleaning procedure.

The invention claimed is:

1. A method for lubricating the roll gap in a rolling stand for rolled strips, the method comprising the steps of lubricating the roll gap by:

feeding water via at least a first feed line and oil via at least a second feed line to at least one mixer;

mixing the water and the oil in the mixer;

feeding the mixture of water and oil to a sprayer; and spraying the mixture from the sprayer onto at least one work roll or backup roll of the rolling stand; and cleaning the roll gap by feeding hot water or steam via at least one third feed line to one of the first and second feed lines or to the mixer at defined time intervals or as a function of a status of the rolling process, while a roll of the rolling stand is being changed.

2. The method according to claim 1, wherein the hot water is supplied at a temperature of at least 60° C.

3. The method according to claim 1, wherein the hot water or the steam is supplied over a period of from 2 to 15 minutes.

4. The method according to claim 1, further comprising the step of:

adding a detergent to the hot water or to the steam.

5. The method according to claim 1, further comprising the step in the event of interrupted supply of:

delivering hot water or steam in the first or in the second feed line.

6. The method according to claim 1, further comprising the step of:

outputting a warning signal during the delivery of hot water or of steam.

7. The method according to claim 1, wherein the water is heated or the steam is generated by means of an electric heating element.

8. The method according to claim 1, wherein the water is heated or the steam is generated by means of oil or gas heating.

9. The method according to claim 1, wherein the water is heated or the steam is generated by means of solar energy.

10. A method for lubricating and cleaning the roll gap in a rolling stand for rolled strips, the method comprising the steps of:

feeding water via at least a first feed line and oil via at least a second feed line to at least one mixer;

mixing the water and the oil in the mixer;

feeding the mixture of water and oil to a sprayer;

spraying the mixture from the sprayer onto at least one work roll or backup roll of the rolling stand;

feeding hot water or steam via at least one third feed line to one of the first and second feed lines or to the mixer at defined time intervals or as a function of a status of the rolling process;

regularly automatically cleaning sprayers;

determining the rolling stand to be cleaned in a multi-stand rolling train; and monitoring and storing the duration of the cleaning.

11. A method for lubricating and cleaning the roll gap in a rolling stand for rolled strips, the method comprising the steps of:

feeding water via at least a first feed line and oil via at least a second feed line to at least one mixer;

mixing the water and the oil in the mixer;

feeding the mixture of water and oil to a sprayer;

spraying the mixture from the sprayer onto at least one work roll or backup roll of the rolling stand;

feeding hot water or steam via at least one third feed line to one of the first and second feed lines or to the mixer at defined time intervals or as a function of a status of the rolling process; and cleaning of the sprayer at the beginning of every nth roll change, after a rolling incident within the rolling stand, at the end of a rolling program before a system stoppage, or manually by a user.

12. A method for lubricating the roll gap in a plurality of rolling stands for rolled strips, the method comprising the steps of:

feeding water via at least a first feed line and oil via at least a second feed line to at least one mixer;

mixing the water and the oil in the mixer;

feeding the mixture of water and oil to a respective sprayer at each of the rolling stands;

spraying the mixture from the sprayers onto at least one work roll or backup roll of each of the rolling stands; and feeding hot water or steam via at least one third feed line to one of the first and second feed lines or to the mixer at defined time intervals or as a function of a status of the rolling process from a single hot water tank, provided for all the rolling stands and feeding each individual rolling stand in turn.

13. A method for lubricating the roll gap in a plurality rolling stands for rolled strips, the method comprising the steps of:

feeding a cold water supply via at least a first feed line and oil via oil pumps and at least a second feed line to at least one mixer;

mixing the water and the oil in the mixer;

to feeding the mixture of water and oil to a sprayer;

spraying the mixture from the sprayer onto at least one work roll or backup roll of the plurality of rolling stands;

determining one of the plurality of rolling stands to be cleaned and a cleaning time therefor;

deactivating the oil pump of the one roll stand;

switching off the cold water supply to the one roll stand;

activating a supply of warm water, steam or detergent for the sprayer of the one stand;

deactivating the warm water supply after the cleaning time has elapsed;

reactivating the cold water supply of the lubrication system; and switching the oil pump for the one roll stand back to operational.

* * * * *